US006402578B1

(12) United States Patent
Zappitelli

(10) Patent No.: US 6,402,578 B1
(45) Date of Patent: Jun. 11, 2002

(54) POOL TOY DEVICE FOR UNDERWIRE SURFING AND RELATED ACTIVITIES

(76) Inventor: Anthony Joseph Zappitelli, 2910 Oklahoma Rd., Willow Grove, PA (US) 19090

( * ) Notice: Subject to any disclaimer, the term of this patent is extended or adjusted under 35 U.S.C. 154(b) by 0 days.

(21) Appl. No.: 09/488,475

(22) Filed: Jan. 20, 2000

(51) Int. Cl.[7] ..... B63C 9/08
(52) U.S. Cl. ..... 441/129; 114/357
(58) Field of Search ..... 114/357; 441/65, 441/74, 129

(56) References Cited

U.S. PATENT DOCUMENTS 3,414,919 A * 12/1968 Gust ..... 114/74
3,732,587 A * 5/1973 Fletcher ..... 114/357
4,333,978 A * 6/1982 Kocher ..... 428/158
5,421,283 A * 6/1995 Bruggemann et al. ..... 114/357
5,807,152 A * 9/1998 Wojcik ..... 441/74

* cited by examiner

*Primary Examiner*—Ed Swinehart
(74) *Attorney, Agent, or Firm*—Emery L. Tracy

(57) ABSTRACT

An assembly for use in water activities is provided. The assembly comprises a first flexible member and a second flexible member. A spring mechanism is secured between the first flexible member and the second flexible member for urging the first flexible member and the second flexible member into a substantially flat configuration.

13 Claims, 5 Drawing Sheets

POOL TOY DEVICE FOR UNDERWIRE SURFING AND RELATED ACTIVITIES

BACKGROUND OF THE INVENTION

1. Field of the Invention

This invention relates generally to toy devices for use in swimming pools or other bodies of water and, more particularly, it relates to pool toy device which can be used and manipulated under the surface of the water, i.e., underwater, for underwater surfing and other related activities.

2. Description of the Prior Art

Swim and play activities in a swimming pool or other body of water is a popular activity for exercise and recreation for both adults and children. Typical water bodies include, but not limited to, beaches, lakes, ponds, water pools, streams, etc. One particular type of water body where persons can swim and play is a designated water park. Water parks have substantially increased in popularity in recent years due to the wide variety of water related activities available to the public including, but not limited to, water slides, wading pools, wave pools, swimming pools, etc.

In the wave pools of the water parks, appropriate wave making equipment creates a wave or series of waves, i.e., to simulate a beach environment, for swimmers to enjoy in variety of manners. Some swimmers enjoy simply standing still as the waves pass them by. Others enjoy body surfing in the waves, typically with a body surfing board which allows a swimmer to surf on top of the water surface and "ride" the wave as the wave travels and eventually dissipates. In general, the typical body board is a short, stiff, non-flexible board designed to receive the swimmer's torso only as the swimmer lies upon the body board. Due to its short, small size and inflexibility, the body surfing board is understandably not capable of supporting an adult's entire body weight upon the water surface. Furthermore, the body surfing board, due to its shortness and rigidity, does not allow a swimmer to position the body board under the water surface and stand on the body board with any degree of comfort or control. The body board, while underwater, is very unstable and, due to its high buoyancy, any underwater surfing with the prior art body board is virtually impossible.

In the past, there have been pool toys, typically called "noodles" which allow a swimmer to support his or her body weight by laying across the pool toy with the pool toy under the arms of the swimmer. The "noodle" is an elongated, flexible device which tends to bend about the swimmer's body. Due to the flexibility of the "noodle", it is not possible for the swimmer to stand on the "noodle" under the water's surface and move with the waves. The "noodle" simply folds about the swimmer's body thereby compromising the swimmer's ability to effectively use the "noodle" for underwater surfing activities and the like.

Accordingly, there exists a need for a pool toy device for underwater surfing and other activities which allows a swimmer to stand on the pool toy device when the pool toy device is beneath the water's surface. Additionally, a need exists for a pool toy device for underwater surfing and other activities which allows a swimmer to not only stand on the pool toy device when the pool toy is beneath the water's surface, but also to move with the waves or other current and surf while standing on the pool toy device. Furthermore, there exists a need for a pool toy device for underwater surfing and other activities which combines elongation with controlled flexibility allowing the swimmer to maneuver the pool toy device to perform underwater surfing activities and the like.

SUMMARY

The present invention is a pool toy device for allowing underwater surfing activities. The pool toy device comprises a water-resistant, flexible element. A resilient member is connected to the flexible element with the resilient member maintaining the flexible member in a substantially flat configuration.

In an embodiment of the present invention, the flexible element includes a first layer and a second layer, the first layer being secured to the second layer. Preferably, the first layer is secured to the second layer by a fastening means selected from the group consisting of stitching, ultrasonic welds, and heat welds. Furthermore, preferably, the resilient member is secured between the first layer and the second layer with an area about a perimeter of the first layer and the second layer which is free from the resilient member.

In another embodiment of the present invention, the first layer has a first section secured to a second section and the second layer has a first section secured to a second section. The first section of the first layer is secured to the first section of the second layer and the second section of the first layer being secured to the second section of the second layer.

In still another embodiment of the present invention, the flexible element is constructed from an extruded foam material.

In yet another embodiment of the present invention, the resilient member is constructed from a substantially flat, elongated plastic material.

In still yet another embodiment of the present invention, the flexible element has a first side edge having a first taper and a second side edge having a second taper. The first taper tapers in a general direction toward the second side edge and the second taper tapers in a general direction toward the first side edge.

In another embodiment of the present invention, the flexible element has a first surface having a third taper and a second surface having a fourth taper, the third taper tapering in a general direction toward the second surface and the fourth taper tapering in a general direction toward the first surface.

The present invention additionally includes an assembly for use in water activities. The assembly comprises a first flexible member having a configuration selected from the group consisting of elongated, square, round, and oval and a second flexible member having a configuration substantially identical to the first flexible member. Spring means are secured between the first flexible member and the second flexible member for urging the first flexible member and the second flexible member into a substantially flat configuration.

In an embodiment of the present invention, the first flexible member is secured to the second flexible member by a fastening means selected from the group consisting of stitching, ultrasonic welds, and heat welds.

In another embodiment of the present invention, the resilient member is constructed from a substantially flat plastic material having a configuration substantially identical to the first and second flexible members.

In still another embodiment of the present invention, the combined first flexible member and second flexible member has a first side edge having a first taper and a second side edge having a second taper. The first taper tapers in a general direction toward the second side edge and the second taper tapers in a general direction toward the first side edge.

In yet another embodiment of the present invention, the first flexible member has a third taper and the second flexible member has a fourth taper. The third taper tapers in a general direction toward the second flexible member and the fourth taper tapers in a general direction toward the first flexible member.

The present invention further includes a method for constructing a pool toy. The method comprises providing a water-resistant, flexible element, and connecting a resilient member to the flexible element with the resilient member maintaining the flexible member in a substantially flat configuration.

In an embodiment of the present invention, the method further comprises providing the flexible element with a first layer and a second layer and securing the first layer to the second layer. Preferably, the method further comprises securing the resilient member between the first layer and the second layer.

In another embodiment of the present invention, the method further comprises providing the flexible element with a first side edge having a first taper and a second side edge having a second taper, tapering the first taper in a general direction toward the second side edge, and tapering the second taper in a general direction toward the first side edge.

In still another embodiment of the present invention, the method further comprises providing the flexible element with a first surface having a third taper and a second surface having a fourth taper, tapering the third taper in a general direction toward the second surface, and tapering the fourth taper in a general direction toward the first surface.

BRIEF DESCRIPTION OF THE DRAWINGS

The pool toy device 10 can be a variety of sizes and shapes. As illustrated in FIG. 1, the pool toy device can be an elongated shape. It should be noted, however, that the size and shape of the pool toy device 10 can be any size and shape including, but not limited to, round (as illustrated in FIG. 8), oval (as illustrated in FIG. 10), square (as illustrated in FIG. 9), rectangular (as illustrated in FIG. 7), etc.

Figure 7:
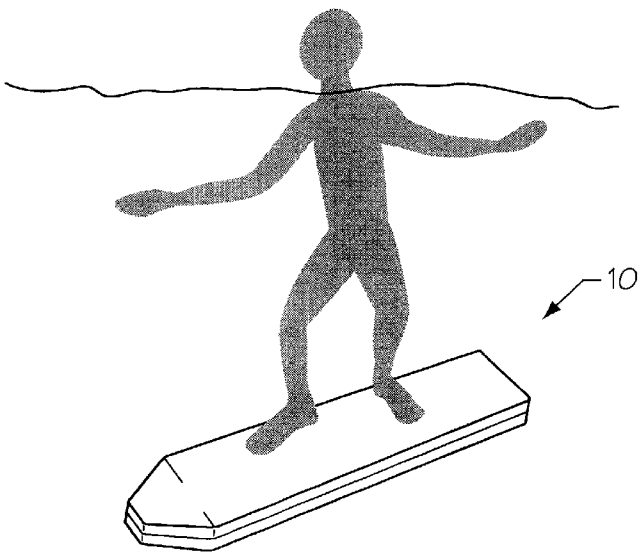
FIG. 7 is a perspective view of the pool toy device for underwater surfing and related activities, constructed in accordance with the present invention, with the pool toy device being used by a surfer.
Figure 9:
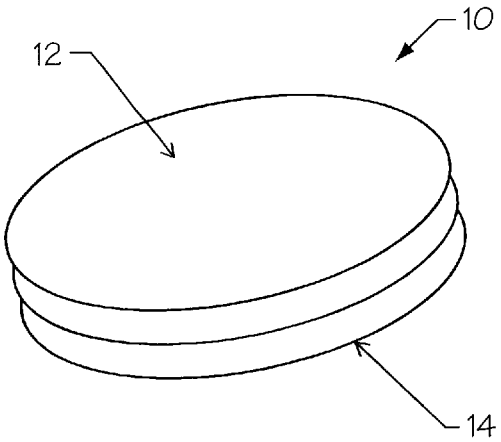
FIG. 9 is a perspective view of a square pool toy device for underwater surfing and related activities, constructed in accordance with the present invention.
Figure 8:
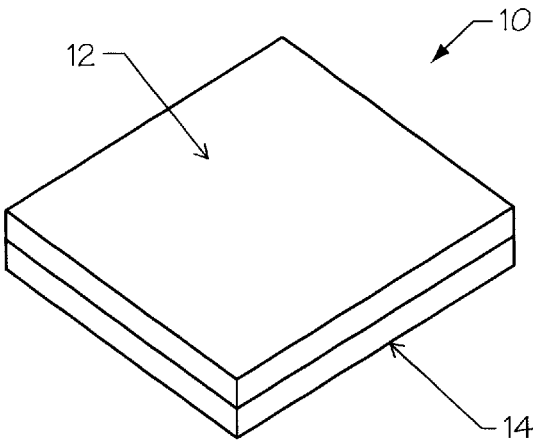
FIG. 8 is a perspective view of a round pool toy device for underwater surfing and related activities, constructed in accordance with the present invention.
Figure 10:
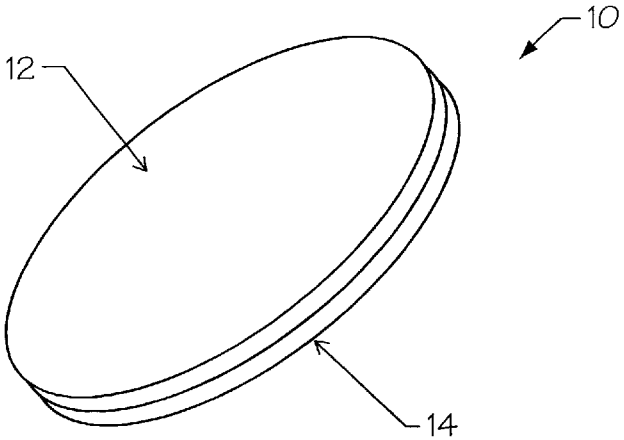
FIG. 10 is a perspective view of an oval pool toy device for underwater surfing and related activities, constructed in accordance with the present invention.

The pool toy device 10 of the present invention is designed to maintain its substantially flat configuration, even with the weight of the person thereupon. Preferably, the pool toy device 10 will maintain the head and shoulders of the user above the surface of the water when the user is standing on the pool toy device 10, regardless of whether the user is an adult or a child, as illustrated in FIG. 7. The inventor of the pool toy device 10 of the present invention believes that the optimum dimensions of the pool toy device 10 to support a person weighing between approximately one hundred and fifty (150 lbs.) and approximately two hundred (200 lbs.) pounds is approximately thirty-six (36") inches in length, approximately six (6") inches in width, and approximately two (2") in thickness and the optimum dimensions of the pool toy device 10 to support a person weighing between approximately eighty (80 lbs.) pounds and approximately one hundred and fifty (150 lbs.) pounds is approximately twenty-eight (28") inches in length, approximately five (5") inches in width, and approximately two (2") in thickness. The pool toy device 10 is designed to flex with the current of the water and the actions of the user, but will be urged back toward its original substantially flat configuration by the spring member 16. The user can maneuver and "surf" underwater, as desired.

DETAILED DESCRIPTION OF THE PREFERRED EMBODIMENTS

Figure 1:
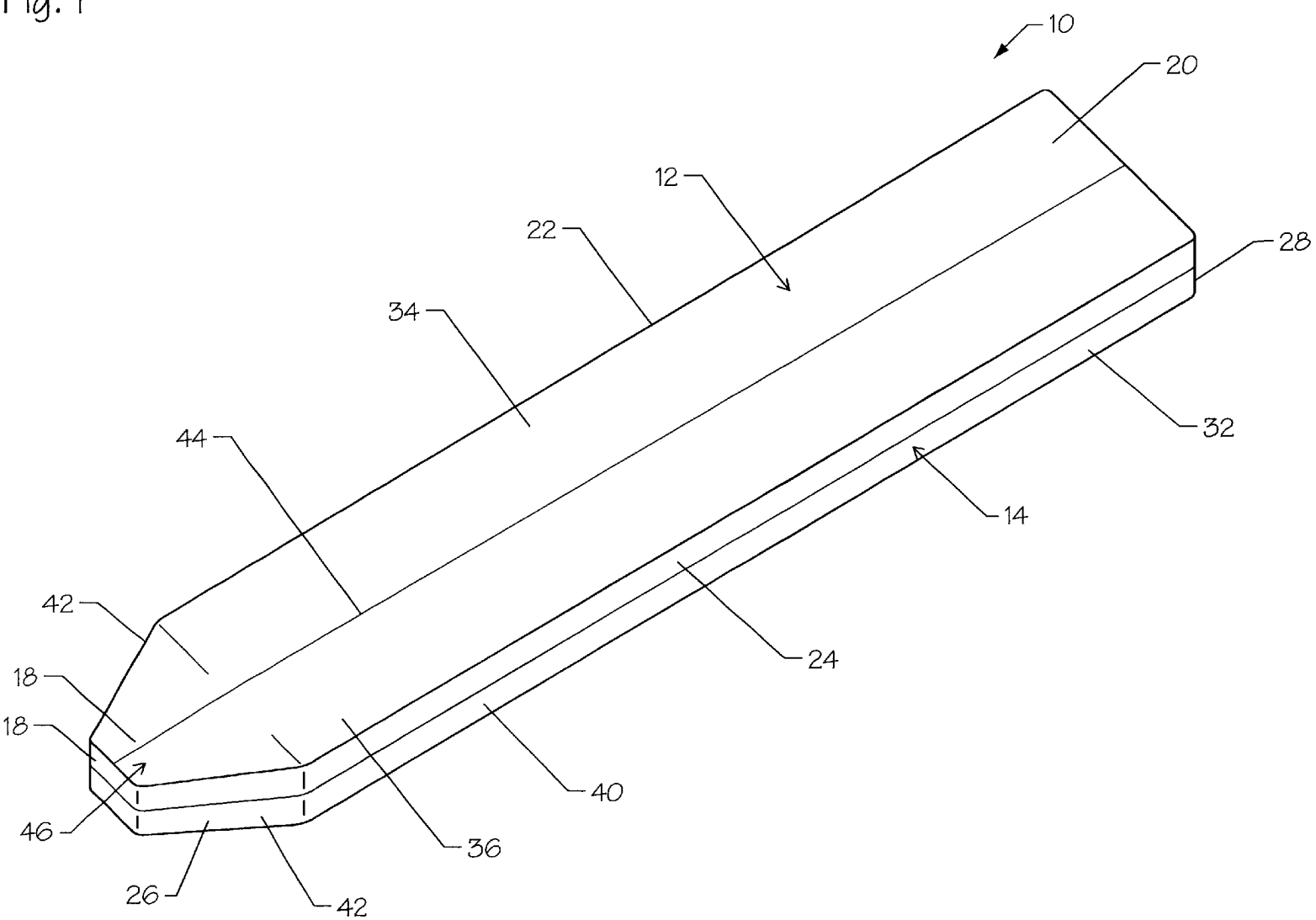
FIG. 1 is a perspective view illustrating a pool toy device for underwater surfing and related activities, constructed in accordance with the present invention.

As illustrated in FIG. 1, the present invention is a pool toy device, indicated generally at 10, for underwater surfing and other related activities. The pool toy device 10 allows a swimmer (not shown) to stand upon the pool toy device 10 when the pool toy device 10 is under the water's surface (not shown) to maneuver and manipulate the pool toy device 10 in any desired direction while maintaining his or her position upon the pool toy device 10.

Figure 3:
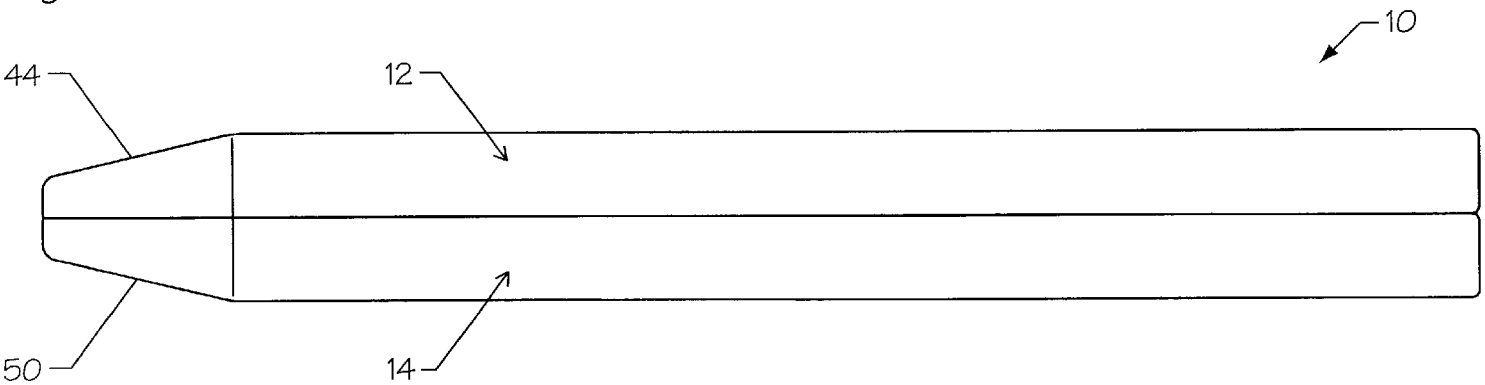
FIG. 3 is a side view illustrating the pool toy device for underwater surfing and related activities of FIG. 1, constructed in accordance with the present invention.
Figure 4:
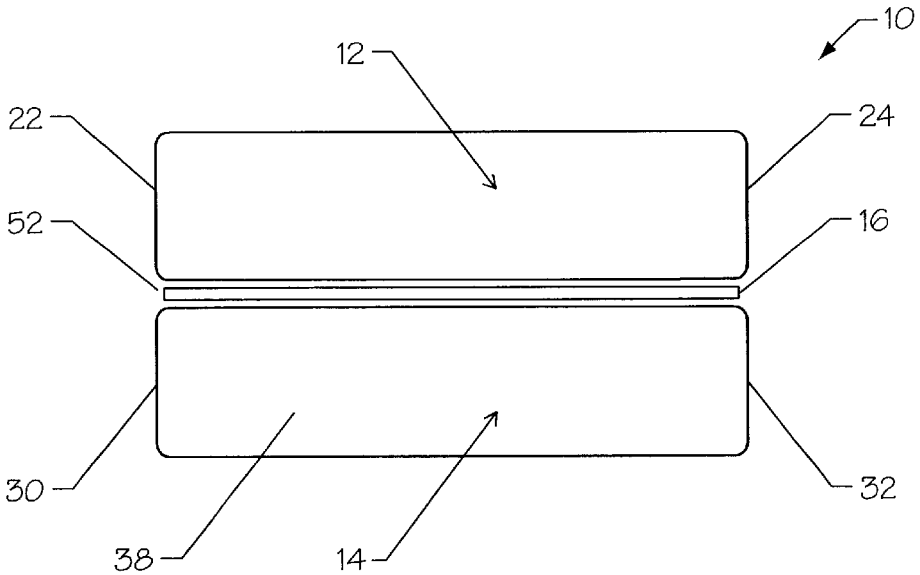
FIG. 4 is a sectional view illustrating the pool toy device for underwater surfing and related activities taken along line 4—4 in FIG. 2, constructed in accordance with the present invention.
Figure 6:
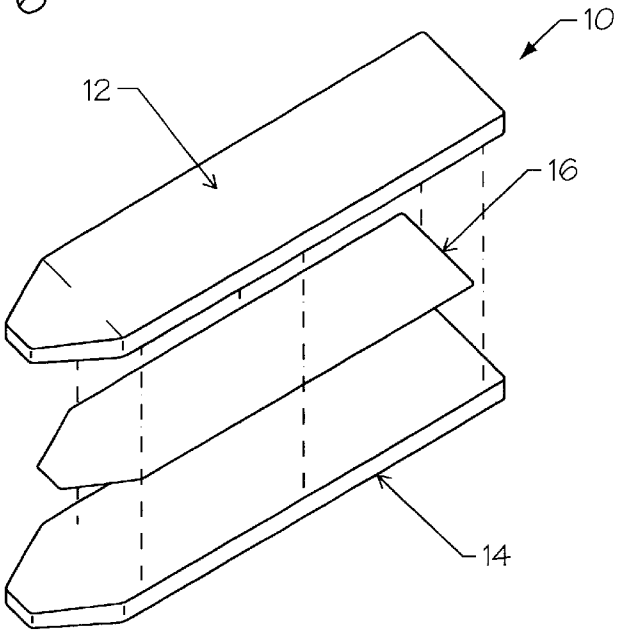
FIG. 6 is an exploded view of the pool toy device for underwater surfing and related activities, constructed in accordance with the present invention.
Figure 5:
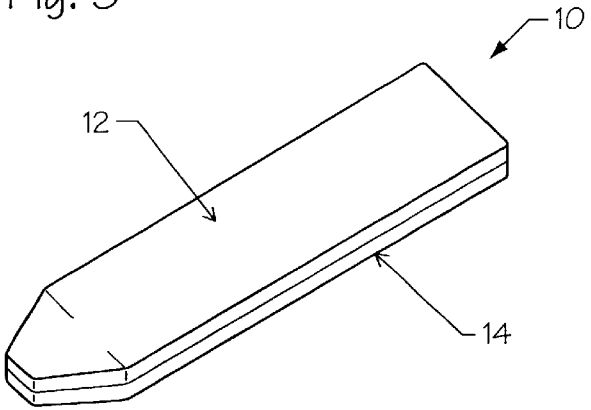
FIG. 5 is another perspective view illustrating the pool toy device for underwater surfing and related activities, constructed in accordance with the present invention.

As illustrated in FIGS. 3 and 4, the pool toy device 10 of the present invention includes a top layer 12, a bottom layer 14, and a spring member 16 sandwiched between the top layer 12 and the bottom layer 14. The top layer 12 of the pool toy device 10 has a first front end 18, a first back end 20, a first right side edge 22, and a first left side edge 24. The bottom layer 14 of the pool toy device 10 has a second front end 26, a second back end 28, a second right side edge 30, and a second left side edge 32. With the spring member 16 therebetween, the top layer 12 and the bottom layer 14 are secured together along the first front end 18 and the second front end 26, the first back end 20 and the second back end 28, the first right side edge 22 and the second right side edge 30, and the first left side edge 24 and the second left side edge 32. Preferably, the top layer 12 and the bottom layer 14 are secured together by either stitching, ultrasonic welding, heat welds, etc., or a combination thereof, although it is within the scope of the present invention to secure the top layer 12 to the bottom layer 14 by any known means.

Figure 2:
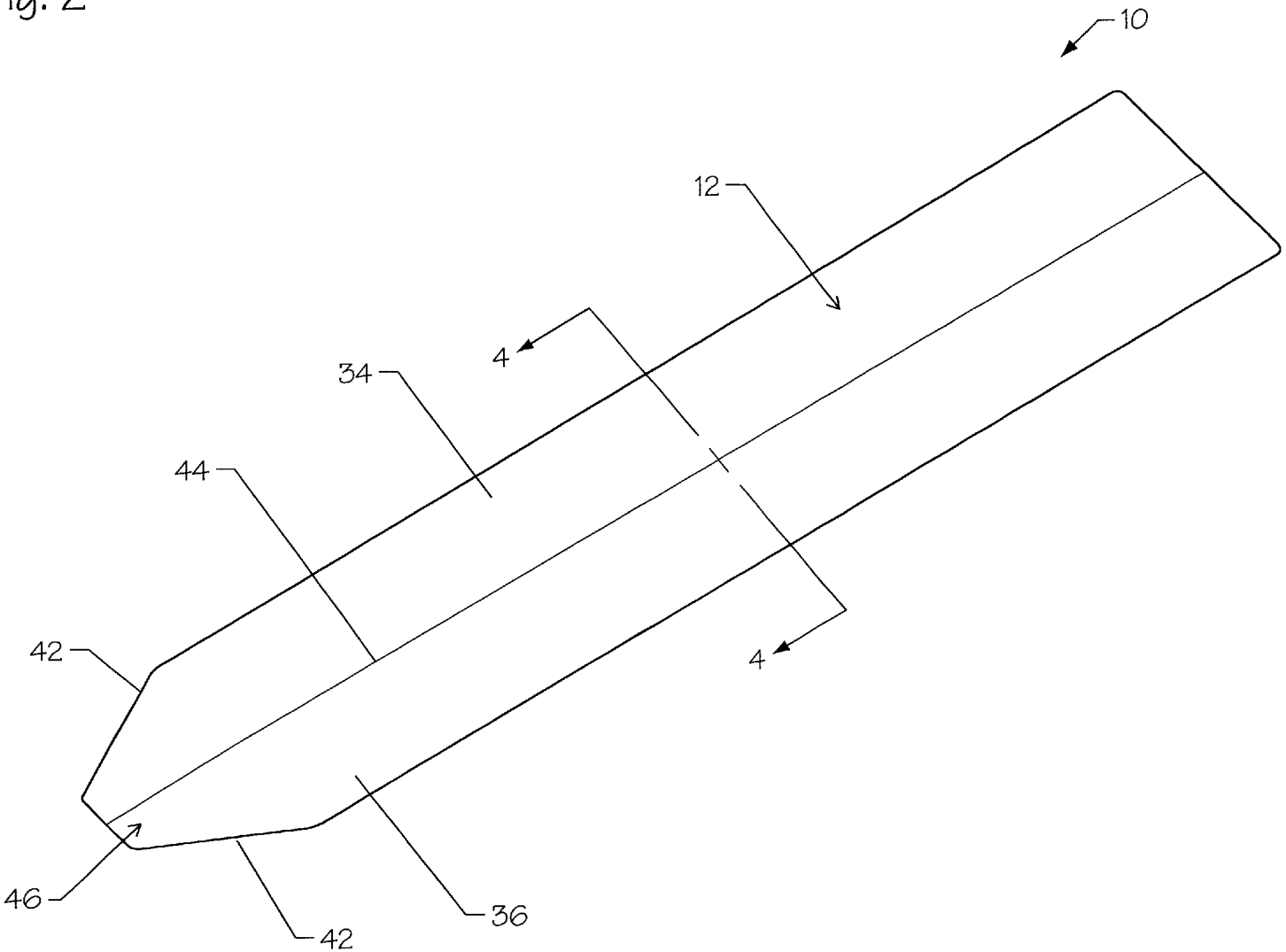
FIG. 2 is top plan view illustrating the pool toy device for underwater surfing and related activities of FIG. 1, constructed in accordance with the present invention.

As illustrated in FIGS. 1 and 2, the top layer 12 can have a first section 34 and a second section 36 and the bottom layer 14 can have a first section 38 and a second section 40. The first section 34 and the second section 36 of the top layer 12 are preferably secured together by stitching, ultrasonic welding, heat welds, etc., or a combination thereof. Additionally, the first section 38 and the second section 40 of the bottom layer 14 are also preferably secured together by stitching, ultrasonic welding, heat welds, etc., or a combination thereof. In a preferred embodiment, the first section 34 and the second section 36 of the top layer 12 and the first section 38 and the second section 40 of the bottom layer 14 are constructed from the same material and can be different colors for aesthetic purposes.

As illustrated in FIG. 2, the first front end 18 of the top layer 12 and the second front end 26 of the bottom layer 14 preferably each have a first taper 42 which tapers in a generally inward direction toward a center line 44 of the top layer 12 and the bottom layer 14, respectively, defining a blunt-pointed end 46. Furthermore, as illustrated in FIG. 3, the first front end 18 has a downward taper 48 and the second front end 26 has an upward taper 50 with the downward taper 48 tapering in a direction generally toward the upward taper 50. Both the first taper 42, the downward taper 48, and the upward taper 50 assist in guiding the pool toy device 10 through the water during underwater surfing activities and the like by the swimmer.

In a preferred embodiment, the top layer 12 and the bottom layer 14 of the pool toy device 10 of the present invention are identically constructed in size and shape from the same material. Preferably, the top layer 12 and the bottom layer 14 are constructed from a water-resistant, flexible material such as an extruded foam, manufactured by Kid Power, Brentwood, Tenn. While the top layer 12 and the bottom layer 14 have been described as being constructed from the same extruded foam material, it is within the scope of the present invention to construct the top layer 12 and the bottom layer 14 from different materials so long as the top layer 12 and the bottom layer 14 with the spring member 16 therebetween tends to float when positioned under or upon the water surface.

The spring member 16 of the pool toy 10 of the present invention is shaped identical to the top layer 12 and the bottom layer 14 such that upon placing the spring member 16 between the top layer 12 and the bottom layer 14, the spring member 16 does not reach the first right side edge 22 and the second right side edge 30 and the first left side edge 24 and the second left side edge 32. Preferably, a gap 52 of approximately one-quarter (¼") inch is present between the spring member 16 and the first right side edge 22 and the second right side edge 30 and the first left side edge 24 and the second left side edge 32.

The spring member 16 is preferably constructed from a resilient plastic material which returns to a substantially flat configuration after bending or otherwise moving the spring member 16 from the flat configuration. Furthermore, the spring member 16 effectively stiffens the top layer 12 and the bottom layer 14 thereby allowing a user to stand upon the pool toy device 10 when the pool toy device 10 is under the surface of the water without having the pool toy device 10 fold or wrap about the user.

During use of the pool toy device 10 of the present invention, the user positions the pool toy device 10 under the water surface. The user then positions his or her feet upon the top layer 12 of the pool toy device 10. Straps or other binding types (not shown) can be added to the pool toy device 10 to assist in maintaining the pool toy device 10 to the user's body during use.

The pool toy device 10 can be a variety of sizes and shapes. As illustrated in FIG. 1, the pool toy device can be an elongated shape. It should be noted, however, that the size and shape of the pool toy device 10 can be any size and shape including, but not limited to, round, oval, square, rectangular, etc.

The pool toy device 10 of the present invention is designed to maintain its substantially flat configuration, even with the weight of the person thereupon. Preferably, the pool toy device 10 will maintain the head and shoulders of the user above the surface of the water when the user is standing on the pool toy device 10, regardless of whether the user is an adult or a child. The inventor of the pool toy device 10 of the present invention believes that the optimum dimensions of the pool toy device 10 to support a person weighing between approximately one hundred and fifty (150 lbs.) and approximately two hundred (200 lbs.) pounds is approximately thirty-six (36") inches in length, approximately six (6") inches in width, and approximately two (2") in thickness and the optimum dimensions of the pool toy device 10 to support a person weighing between approximately eighty (80 lbs.) pounds and approximately one hundred and fifty (150 lbs.) pounds is approximately twenty-eight (28") inches in length, approximately five (5") inches in width, and approximately two (2") in thickness. The pool toy device 10 is designed to flex with the current of the water and the actions of the user, but will be urged back toward its original substantially flat configuration by the spring member 16. The user can maneuver and "surf" underwater, as desired.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

I claim:

1. A pool toy device for underwater surfing activities, the pool toy device comprising:

a water-resistant, flexible element, the flexible element having a first layer secured to a second layer, the first layer having a first section secured to a second section and the second layer having a first section secured to a second section, the first section of the first layer being secured to the first section of the second layer and the second section of the first layer being secured to the second section of the second layer; and a resilient member positioned entirely between the first layer of the flexible element and the second layer of the flexible element, such that the entire resilient member is completely surrounded by first layer and the second layer;

wherein the resilient member maintains the flexible member in a substantially flat configuration.

2. The pool toy device of claim 1 wherein the flexible element includes a first layer and a second layer, the first layer being secured to the second layer.

3. The pool toy device of claim 1 wherein the first layer is secured to the second layer by a fastening means selected from the group consisting of stitching, ultrasonic welds, and heat welds.

4. The pool toy device of claim 1 wherein the resilient member is secured between the first layer and the second layer.

5. The pool toy device of claim 4 and further comprising an area about a perimeter of the first layer and the second layer which is free from the resilient member.

6. The pool toy device of claim 1 wherein the flexible element is constructed from an extruded foam material.

7. The pool toy device of claim 1 wherein the resilient member is constructed from a substantially flat, elongated plastic material.

8. The pool toy device of claim 1 wherein the flexible element has a first side edge having a first taper and a second side edge having a second taper, the first taper tapering in a general direction toward the second side edge and the second taper tapering in a general direction toward the first side edge.

9. The pool toy device of claim 8 wherein the flexible element has a first surface having a third taper and a second surface having a fourth taper, the third taper tapering in a general direction toward the second surface and the fourth taper tapering in a general direction toward the first surface.

10. An assembly for use in water activities, the assembly comprising:

a first flexible member having a configuration selected from the group consisting of elongated, square, round, and oval;

second flexible member having a configuration substantially identical to the first flexible member; and spring means secured entirely between the first flexible member and the second flexible member for urging the first flexible member and the second flexible member into a substantially flat configuration;

wherein the spring means is constructed from a substantially flat plastic material having a configuration substantially identical to the first flexible member and the second flexible member.

11. The assembly of claim 10 wherein the first flexible member is secured to the second flexible member by a fastening means selected from the group consisting of stitching, ultrasonic welds, and heat welds.

12. The assembly of claim 11 wherein the combined first flexible member and second flexible member has a first side edge having a first taper and a second side edge having a second taper, the first taper tapering in a general direction toward the second side edge and the second taper tapering in a general direction toward the first side edge.

13. The assembly of claim 12 wherein the first flexible member has a third taper and the second flexible member has a fourth taper, the third taper tapering in a general direction toward the second flexible member and the fourth taper tapering in a general direction toward the first flexible member.

* * * * *

UNITED STATES PATENT AND TRADEMARK OFFICE

CERTIFICATE OF CORRECTION

PATENT NO. : 6,402,578 B1
DATED : June 11, 2002
INVENTOR(S) : Anthony Joseph Zappitelli It is certified that error appears in the above-identified patent and that said Letters Patent is hereby corrected as shown below:

Title page Item [54], and Column 1, lines 1-2,
The title should read -- POOL TOY DEVICE FOR UNDERWATER SURFING AND RELATED ACTIVITIES --.

Signed and Sealed this

Sixth Day of August, 2002

*Attest:*

*Attesting Officer*

JAMES E. ROGAN
*Director of the United States Patent and Trademark Office*